United States Patent [19]

Rosenfeld et al.

[11] Patent Number: 5,076,352

[45] Date of Patent: Dec. 31, 1991

[54] HIGH PERMEABILITY HEAT PIPE WICK STRUCTURE

[75] Inventors: John H. Rosenfeld; Robert F. Keller, both of Lancaster, Pa.

[73] Assignee: Thermacore, Inc., Lancaster, Pa.

[21] Appl. No.: 652,605

[22] Filed: Feb. 8, 1991

[51] Int. Cl.[5] ..... ..... F28D 15/02

[52] U.S. Cl. ..... 165/104.26; 122/366

[58] Field of Search ..... 165/104.26; 122/366

[56] References Cited

U.S. PATENT DOCUMENTS

| | | | |
|---|---|---|---|
| 3,537,514 | 11/1970 | Levendahl | 165/104.26 |
| 3,681,843 | 8/1972 | Arcella et al. | 165/104.26 |
| 3,892,273 | 7/1975 | Nelson | 165/104.26 |
| 3,901,311 | 8/1975 | Kosson et al. | 165/104.26 |
| 4,003,427 | 1/1977 | Leinoff et al. | 165/104.26 |
| 4,046,190 | 9/1977 | Marcus et al. | 165/104.26 |
| 4,196,504 | 4/1980 | Eastman | 165/104.26 |
| 4,394,344 | 7/1983 | Werner et al. | 165/104.26 |
| 4,765,396 | 8/1988 | Seidenberg | 165/104.26 |
| 4,854,379 | 8/1989 | Shanbach et al. | 165/104.26 |

FOREIGN PATENT DOCUMENTS

| | | | |
|---|---|---|---|
| 649938 | 2/1979 | U.S.S.R. | 165/104.26 |

*Primary Examiner*—Albert W. Davis, Jr.
*Attorney, Agent, or Firm*—Martin Fruitman

[57] ABSTRACT

A high permeability wick structure for heat pipes. A thin capillary liquid transport structure is encased within relatively thick sections of a plastic bonded aluminum powder wick. The capillary structure is formed of two layers of fine mesh screen separated only by small, randomly located, powdered metal granules. The capillary liquid transport structure can be built in numerous cross sectional configurations, including annular rings or spoke like radial sections.

11 Claims, 2 Drawing Sheets

HIGH PERMEABILITY HEAT PIPE WICK STRUCTURE

SUMMARY OF THE INVENTION

This invention deals generally with heat transfer, and more specifically with a wick structure for heat pipes.

Heat pipes are sealed, evacuated devices that transfer heat by evaporating and condensing a working fluid. They are passive devices which require no external power for their operation. In a typical heat pipe, heat is put into the evaporator section, which is usually located at one end of the pipe-like casing structure, and the heat entering the heat pipe evaporates some of the working fluid. This increases the vapor pressure in the region of the evaporator and causes the vapor to flow through the vapor space of the heat pipe toward the condenser section, which is usually at the other end of the structure. Since the heat pipe is set up so that the condenser section is cooler than the evaporator section, the vapor condenses in the condenser section giving up the heat which was put in the evaporator section, and the resulting liquid is returned to the evaporator by capillary action in a wick structure within the heat pipe. At the evaporator, the cycle begins again.

The wick structure of a heat pipe, which is usually composed of adjacent layers of screening or a sintered powder structure with interstices between the particles of powder, can sometimes be the limiting factor in a heat pipe's ability to transfer heat. Such a circumstance occurs when the liquid forming in the condenser section of the heat pipe is transported back to the evaporator section at a slower rate than the vapor which forms the liquid is moved toward the condenser region. In that situation, liquid will accumulate in the condenser section until none of the liquid in the heat pipe is available at the evaporator for evaporation and removal of heat. This condition is aggravated in heat pipes which are particularly long, because greater quantities of vapor in the vapor space and liquid in the wick are in transit, and are therefore not available to the evaporator. Such a "drying out" condition can cause overheating at the evaporator and can even destroy a heat pipe. Therefore, there has been considerable effort to improve the liquid transport capability of heat pipe wicks, and to thus improve the heat transfer limits of heat pipes.

One such effort has been the addition of arteries within or adjacent to the wick. An artery is essentially a small pipe through which liquid also moves from the condenser to the evaporator, and, like the wick itself, it moves the liquid by means of capillary pumping. Since arteries have cross section dimensions orders of magnitude larger than the interstices within a wick structure, they generally have much less resistance to liquid flow. Unfortunately, however the same larger cross sectional dimensions which reduce flow resistance also decrease the capillary pumping ability of arteries. Heat pipe designs have therefore hit another liquid transport limitation.

The present invention overcomes this limitation by furnishing capillary structures within bonded powder wicks which have high pumping capability, and which also have low resistance to liquid flow.

This is accomplished in the preferred embodiment of the invention by constructing a very thin but very wide capillary structure within a plastic bonded powdered metal wick. The thickness of the capillary structure is actually of the same order of magnitude as the grains of powder in the granular powder wick structure itself, and, therefore, the capillary structure has the same strong capillary pumping capability as the wick. However, the large width dimension of the capillary structure provides low liquid flow resistance, so that the capillary structure furnishes all the benefits desired from such a structure.

In the preferred embodiment, the capillary structure is constructed as an annular ring within a plastic bonded aluminum powder wick. The annular capillary structure is actually two layers of stainless steel wire cloth separated by grains of powdered metal. The capillary spacing of the annular structure, which is determined by its smallest dimension, is therefore essentially the same as that of the wick itself. In the width dimension, however, the annular configuration gives the structure a comparatively unlimited dimension, many orders of magnitude larger than the very small thickness, so that resistance to liquid flow is low.

Actual measurements on the preferred embodiment of the invention indicate that the plastic bonded aluminum powder wick with the annular capillary structure has a permeability three times greater than that of such a wick without the annular structure, and that the structure of the preferred embodiment has a permeability nine times greater than a simple sintered aluminum powder wick. The present invention is therefore ideal for long, small diameter heat pipes in which it greatly increases both performance and reliability.

DETAILED DESCRIPTION OF THE INVENTION

Figure 1:
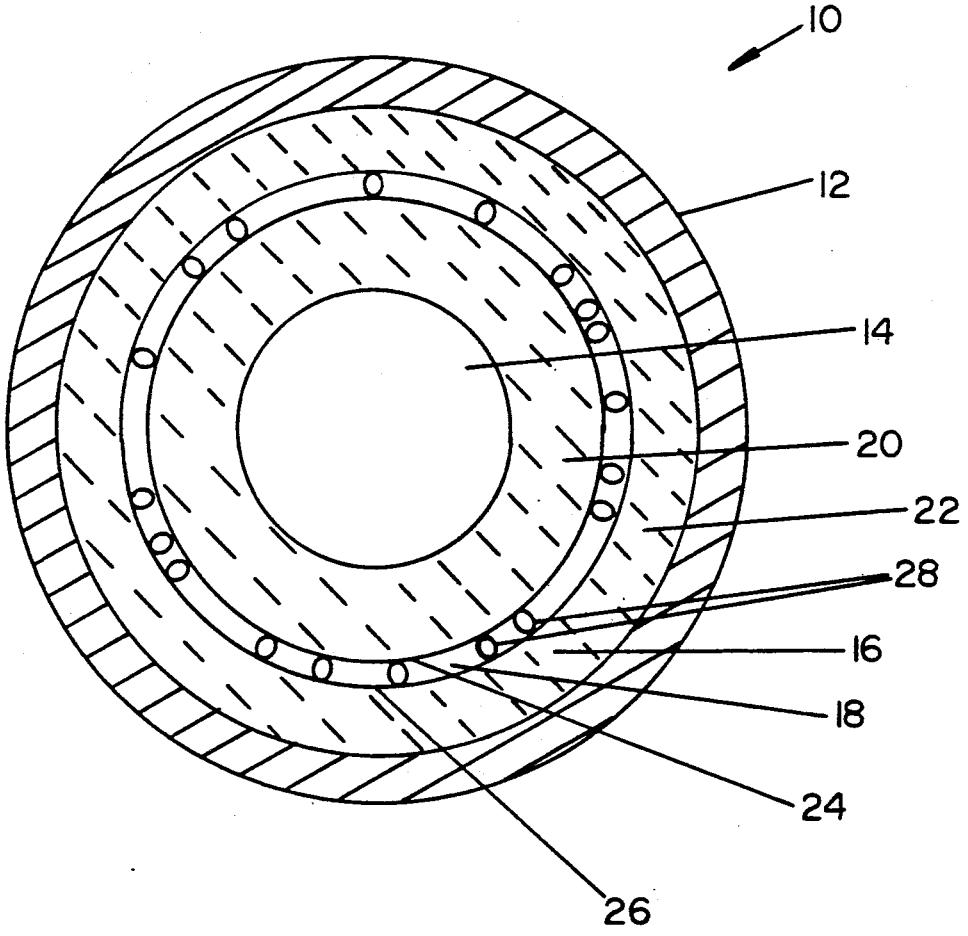
FIG. 1 is a cross section view across the axis of a heat pipe which includes the wick of the preferred embodiment.

The preferred embodiment of the invention is shown in FIG. 1 which is a cross section view of a simple cylindrical heat pipe, with the cross section taken across the heat pipe axis in either the condenser region or in the adiabatic region, the region between the condenser and the evaporator. FIG. 1 shows heat pipe 10 including casing 12 forming the vacuum tight enclosure, centrally located vapor space 14, wick 16 and annular capillary structure 18. Except for the presence of annular capillary structure 18 and the particular construction of wick 16, the construction of heat pipe 10 is quite conventional.

It should be appreciated that FIG. 1 is not drawn to scale, and, particularly, that the thickness of capillary structure 18 is exaggerated in order to better show its structure.

As in most heat pipes, casing 12 is a relatively long cylinder, and vapor space 14 is an open space along the axis of heat pipe 10, although the location of vapor space 14 and the shape of casing 12 has no bearing on the present invention.

In the preferred embodiment of the invention, wick 16 is constructed of plastic bonded aluminum powder. The technique involves coating small granules of aluminum powder with a polymer coating, forming the coated powder into a desired structure, and subjecting the structure to heat to solidify it. This technique is well understood in the art of powdered metal structures.

In the preferred embodiment, such a plastic bonded aluminum powder structure is formed into cylindrical wick 16 on the inside of casing 12 by pouring the coated powder granules into the casing while a mandrel is located in the position of vapor space 14. Also, during the formation of wick 16, capillary structure 18 is held within casing 12 in a location so that wick 16 is actually formed into two separated sections, 20 and 22. After the bonding of wick 16, the central mandrel within vapor space 14 is withdrawn, and heat pipe 10 appears as shown in FIG. 1, with capillary structure 18 locked firmly within wick 16.

Capillary structure 18 itself is constructed in a unique manner prior to its placement within heat pipe 10. Capillary structure 18 is composed of two layers of perforated material, 24 and 26, such as screen or perforated sheet, separated only by granules of metal powder 28. In the preferred embodiment, the perforated material used is stainless steel wire cloth with a 250×250 mesh, and the metal powder granules have an average diameter of 0.0045 inches which is approximately the same size as the pores in the 125 mesh powder of the wick. In order to make the capillary structure self priming the separator granules should be no less then one-half and no more than twice the diameter of the average pore size within the powdered wick within which the capillary structure is located.

Capillary structure 18 is essentially formed by bonding the separator granules to one perforated sheet and then placing the second perforated sheet on the separator granules and attaching the sheets together. One method of accomplishing this is by simply sprinkling plastic coated metal granules upon one sheet of wire cloth, heating the assembly to bond the metal granules in place on the sheet of wire cloth, and then placing the other sheet of wire cloth on top of the metal granules and welding the edges of the wire cloth layers together. After capillary structure 18 is constructed, it can easily be rolled into a cylinder so that it will fit within heat pipe 10 as shown in FIG. 1.

Other methods of construction of the capillary structure can also be used. For instance, the annular structure can be built by forming a cylinder of one layer of the perforated sheet material and then coating another sheet with a water soluble adhesive, sprinkling the separator granules on the second sheet, wrapping the second sheet and the attached granules around the first sheet, and then washing out the adhesive.

Wick 16 including capillary structure 18 formed and located in this manner results in a wick with permeability superior to that of previous wicks, but the configuration of the capillary structure of the invention need not be limited to a cylinder.

Figure 2:
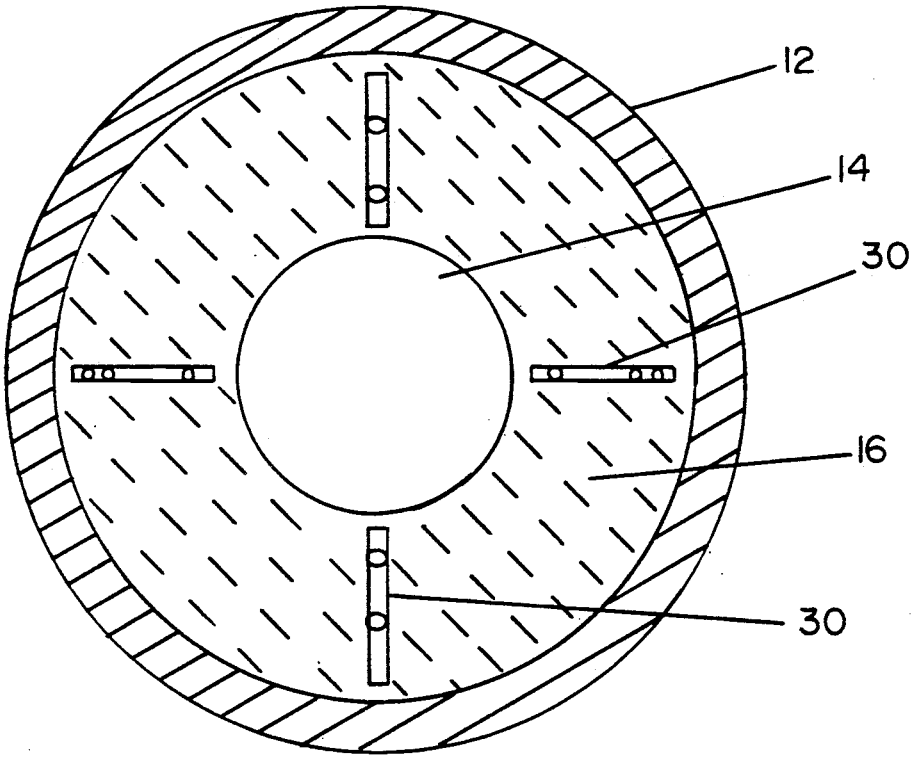
FIG. 2 is a cross section view across the axis of a heat pipe which includes an alternate embodiment of the invention.

FIG. 2 shows one alternate embodiment of the invention, with several capillary structures 30 shaped as planar structures and located on radii of the axis of casing 12. This configuration and others, such as multiple coaxial annular rings, or even non-coaxial tubes formed of the granule separated screening, could be used.

The benefit derived from the wick structure of the invention is that the small spacing between the screen layers provides excellent capillary pumping while the relatively large width dimension along the screen assures low resistance to liquid flow.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the shape of the heat pipe into which the wick of the present invention is placed may be varied, and the specific materials and bonding method used to construct the wick and the capillary structure may also be changed. For instance, polymer powder can be used for the wick, or conventional sintering can be used to form the wick. Furthermore, the capillary structure may include more than two layers of screen.

What is claimed as new and for which Letters Patent of the United States are desired to be secured is:

1. A heat pipe wick structure comprising:

a bonded powder wick extending between a condenser section and an evaporator section within a heat pipe; and a capillary structure within the bonded powder wick, the capillary structure formed of at least two layers of perforated material separated by granules of powdered material, with the capillary structure extending at least from the condenser section to a location adjacent to the evaporator section.

2. The heat pipe wick structure of claim 1 wherein the granules separating the perforated material layers have an average diameter in the range of between one-half and two times the average pore size of the powdered wick.

3. The heat pipe wick structure of claim 1 wherein the capillary structure is shaped as a cylinder.

4. The heat pipe wick structure of claim 1 wherein the capillary structure is at least one planar structure.

5. The heat pipe wick structure of claim 1 wherein the capillary structure is shaped as a cylinder and located coaxial to the axis of a cylindrical casing of a heat pipe.

6. The heat pipe wick structure of claim 1 wherein the capillary structure is at least two separated planar structures which are each located on radii extending from the axis of a cylindrical casing of a heat pipe.

7. The heat pipe wick structure of claim 1 wherein the layers of the capillary structure are constructed of wire cloth of 250×250 mesh.

8. The heat pipe wick structure of claim 1 wherein the bonded powder wick is constructed of polymer bonded metal powder.

9. The heat pipe wick structure of claim 1 wherein the bonded powder wick is constructed of polymer bonded aluminum powder.

10. The heat pipe wick structure of claim 1 wherein the bonded powder wick is constructed of sintered metal powder.

11. The heat pipe wick structure of claim 1 wherein the bonded powder wick is constructed of polymer powder.

* * * * *